US006491415B2

(12) United States Patent
Orellana

(10) Patent No.: US 6,491,415 B2
(45) Date of Patent: Dec. 10, 2002

(54) GLOBE LIGHTING ASSEMBLY

(75) Inventor: Angel M. Orellana, Los Angeles, CA (US)

(73) Assignee: U.S. Pole Company, Inc., Sun Valley, CA (US)

( * ) Notice: Subject to any disclaimer, the term of this patent is extended or adjusted under 35 U.S.C. 154(b) by 0 days.

(21) Appl. No.: 09/732,643

(22) Filed: Dec. 8, 2000

(65) Prior Publication Data

US 2001/0030869 A1 Oct. 18, 2001

Related U.S. Application Data

(60) Provisional application No. 60/170,115, filed on Dec. 10, 1999, and provisional application No. 60/175,317, filed on Jan. 10, 2000.

(51) Int. Cl.[7] ..... F21V 17/00

(52) U.S. Cl. ..... 362/375; 362/362; 362/363; 362/376; 362/185; 362/186; 362/809

(58) Field of Search ..... 362/375, 374, 362/362, 363, 376, 185, 186, 356, 809

(56) References Cited

U.S. PATENT DOCUMENTS 783,772 A * 2/1905 Billingham ..... 362/314
5,477,441 A * 12/1995 Budnovitch et al. ..... 362/267
D446,593 S 8/2001 Straus et al. ..... D26/69

* cited by examiner

*Primary Examiner*—Stephen Husar
*Assistant Examiner*—Bertrand Zeade
(74) *Attorney, Agent, or Firm*—Christie, Parker & Hale, LLP

(57) ABSTRACT

A globe lighting assembly comprises a metal cage, a plastic globe at least partially surrounded by the metal cage, a reflector reflecting light from a light source throughout the globe, and a socket clip disposable into the reflector. The socket clip includes legs having at least one position along each of the legs corresponding to settings for the light source in the reflector. The metal cage has lower and upper rings, and prongs which all surround and give structural support for at least one of an upper portion and a lower door of the globe. The upper portion is hingedly connected to the lower door. The lower door has a circular rim that fits into an inner surface of the lower ring when the globe is in the closed position. As a result, the circular rim of the lower portion is not viewable from the outside of the globe. The lower ring of the cage has an inner circular lip that aids in preventing moisture from entering an interior of the globe. The upper portion of the globe has a bottom edge that attaches to the lower ring just to an outside of the inner circular lip to aid in preventing moisture from entering the interior of the globe. The prongs are aligned with flanges and lip extensions extending from the inner circular lip. The prongs are spaced approximately equally from each other around the globe.

31 Claims, 10 Drawing Sheets

GLOBE LIGHTING ASSEMBLY

CROSS REFERENCE TO RELATED APPLICATIONS

This application claims priority to U.S. Provisional Patent Application No. 60/170,115 filed Dec. 10, 1999 and U.S. Provisional Patent Application No. 60/175,317, filed Jan. 10, 2000, the contents of which are hereby incorporated by reference.

FIELD OF THE INVENTION

This invention relates to a globe lighting assembly having a globe and a cage surrounding the globe that lets light diffuse from both a top and a bottom of the globe.

BACKGROUND OF THE INVENTION

Lighting assemblies generally emit light from either a top or a bottom of the assembly. Emitting light from each of the top, the bottom, and the sides of the assembly presents several difficulties in manufacturing of the assembly. In particular, the placement of a lamp and of a reflector, if any, will effectively block the light in one of the directions.

SUMMARY OF THE INVENTION

A globe lighting assembly comprises a metal cage, and a plastic globe with an upper portion and a lower portion. The globe lighting assembly also has an open position, and a closed position. The globe is substantially spherical with the upper portion and the lower portion substantially being two separable hemispheres of the sphere. The upper portion is hingedly connected to the lower portion to move between the closed position and the open position.

The metal cage has a lower ring, an upper ring, prongs, and a hub. The hub connects the assembly to a post or an arm. The lower and upper rings along with the prongs surround and give structural support for an upper portion of the globe. There are four prongs spaced approximately equal from each other around the globe.

The lower ring has an inner circular lip. The upper portion of the globe has a bottom edge that abuts against the lower ring just to an outside of the inner circular lip. The inner circular lip aids in preventing moisture from entering the interior of the globe, along with gaskets and silicon sealant.

The lower ring has lip extensions with flanges. The number of lip extensions, the spacing between the lip extensions, the width of the lip extensions, as well as the location of the lip extensions each correspond to that of the prongs. The flanges are parallel to the upper ring. As a result of the flanges positioning, the light from a lamp will cast the shadow of the flanges onto the cage, and will not be seen from outside the globe.

The lower portion of the globe has an upper circular rim that fits into an inner surface of the lower ring when the globe is in the closed position. As a result, the upper circular rim of the lower portion is not viewable from the outside of the globe.

The globe lighting assembly further comprises a reflector with a rim. The rim of the reflector attaches to the flanges. The reflector has an aperture covered with a light diffuser so that light diffuses substantially through the upper portion of the globe, as well as the bottom portion of the globe. The light diffuser is translucent, preferably plastic and glass between the plastic and a light source. The plastic is an opal polycarbonate diffuser or an acrylic plastic. The glass is clear tempered glass.

The globe lighting assembly further comprises a metal socket clip. The reflector has an aperture dimensioned to receive the socket clip. The socket clip has four legs with multiple settings along each of the legs. The multiple settings are for light source positions. The legs are flexible and are biased outwards from each other such that there is adequate resistance to maintain and hold the socket clip in the determined setting.

An alternative embodiment of the globe lighting assembly comprises a cage, and a globe surrounded by the cage. The cage has a bottom ring, a top ring, prongs, and a hub. The bottom and top rings, along with the prongs give structural support for the globe at a lower portion. There are four prongs spaced approximately equal from each other around the globe.

Many of the attendant features of this invention will be more readily appreciated as the same becomes better understood by reference to the following detailed description and considered in connection with the accompanying drawings in which like reference symbols designate like parts throughout.

DETAILED DESCRIPTION OF THE INVENTION

Figure 1:
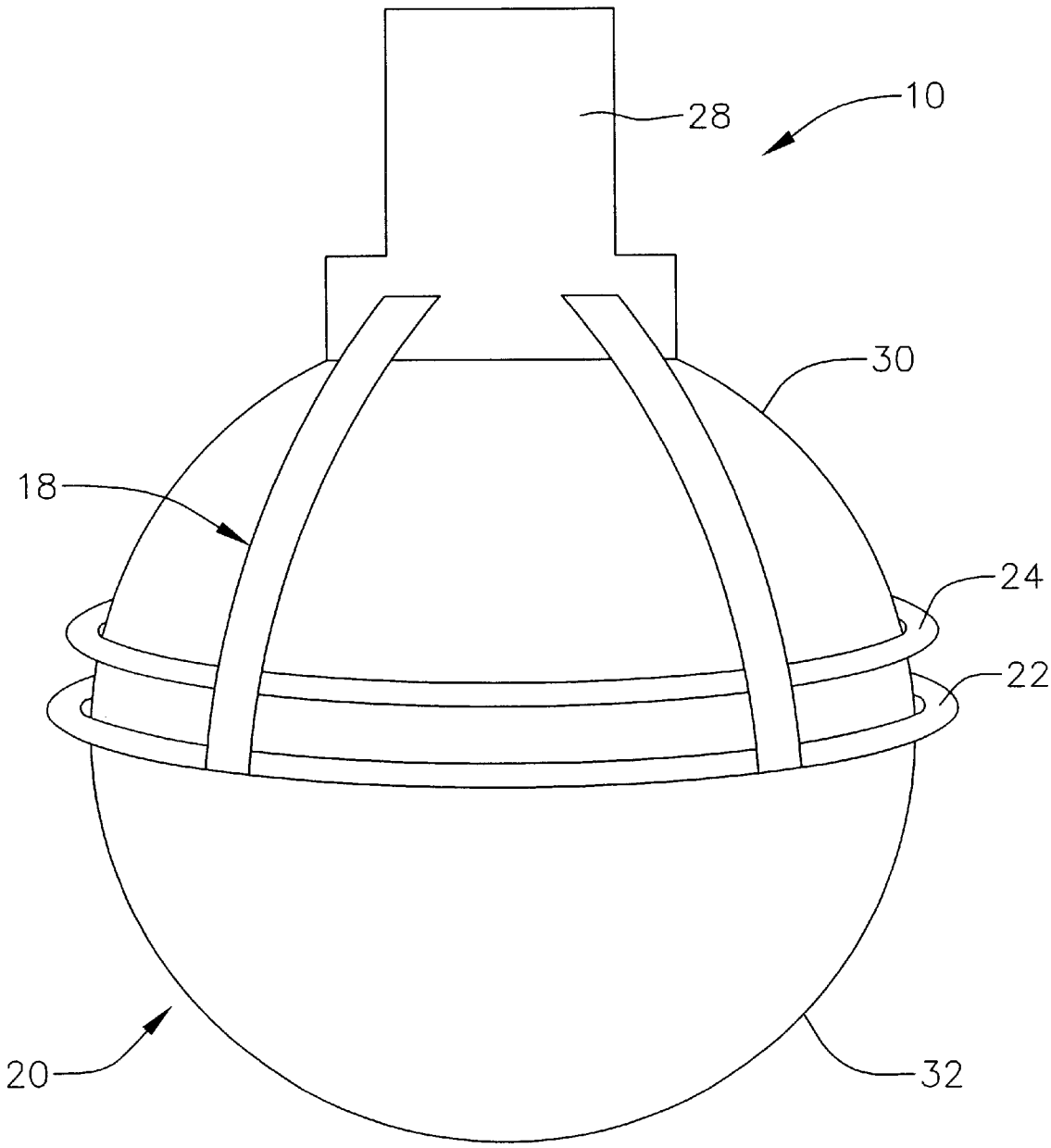
FIG. 1 is a perspective view of an embodiment of a globe lighting assembly.
Figure 3:
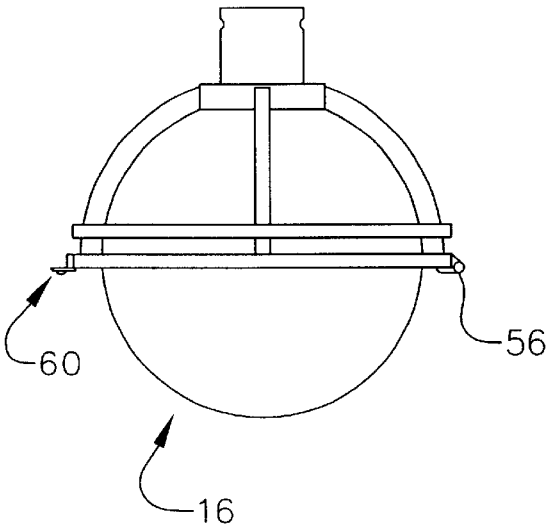
FIGS. 2 to 4 are side views of the globe lighting assembly illustrating the steps to opening the lower door.

FIG. 1 illustrates an embodiment of a globe lighting assembly 10 of the present invention. The globe lighting assembly 10 has an open position 14 (FIG. 4), a closed position 12 (FIG. 2), and an intermediate position 16 in between the open and closed positions (FIG. 3). The open position 14 is the position in which maintenance on the assembly is capable of being performed. The closed position 12 is an operational position of the assembly.

The globe lighting assembly has a cage 18, and a spherical globe 20 surrounded by the cage 18. Preferably, the globe 20 is made of plastic, and the cage 18 is made of metal. The cage 18 has a lower ring 22, an upper ring 24 parallel to the lower ring, prongs 26, and a hub 28 from which the prongs 26 extend to the lower ring 22 through the upper ring 24.

The spherical globe has substantially two hemispheres: a hollow, hemispherical upper portion 30 and a lower door 32.

The lower ring 22 and the upper ring 24, along with the prongs 26, surround and give structural support for the upper portion 30 of the globe 20. Each prong 26 has a shape that follows an outside surface of the hemispherical upper portion 30. Generally, there are four prongs 26, each spaced approximately equal from each other around the globe 20.

Figure 5:
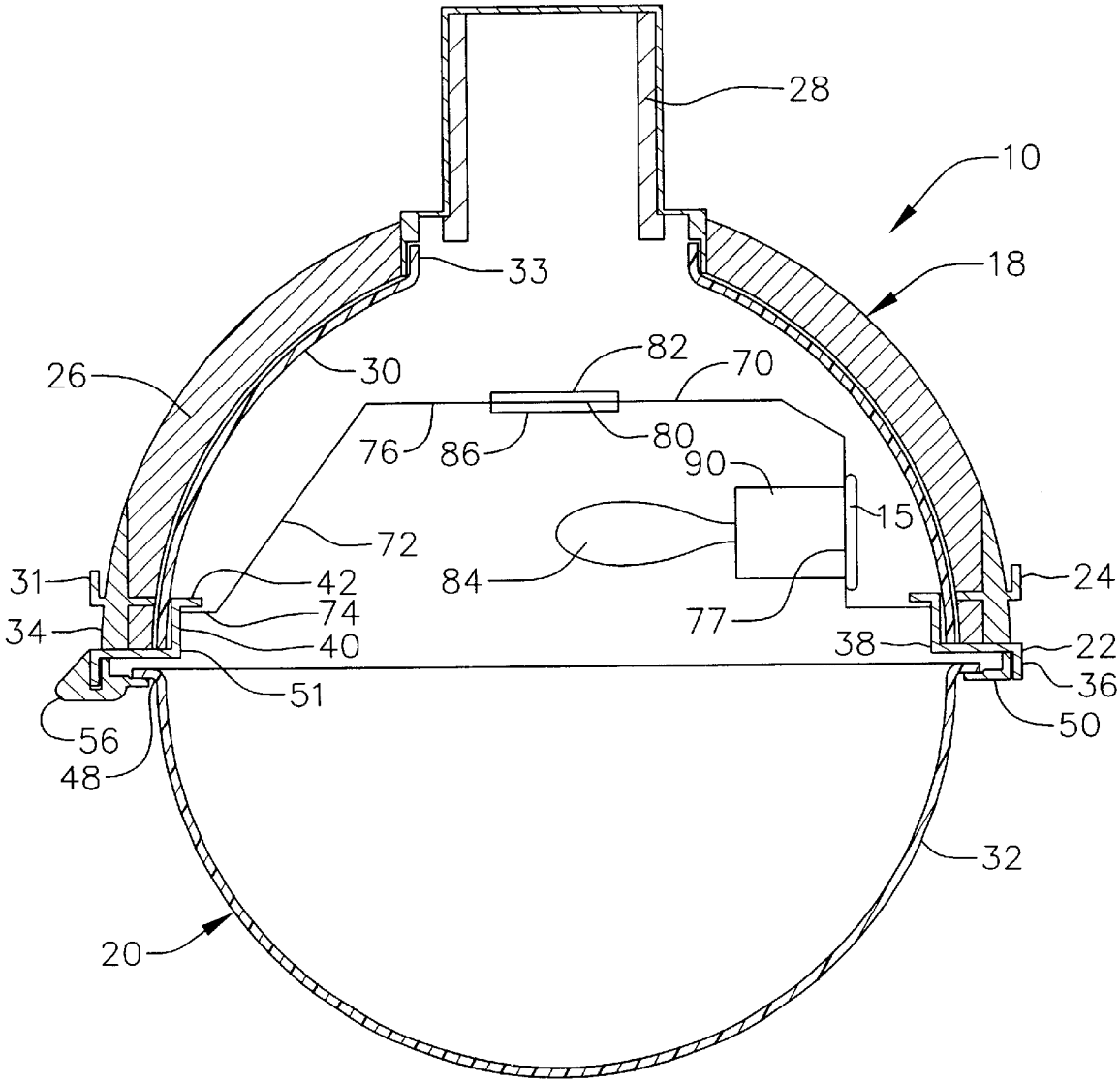
FIG. 5 is a cross-sectional view of the embodiment of FIG. 1.
Figure 6:
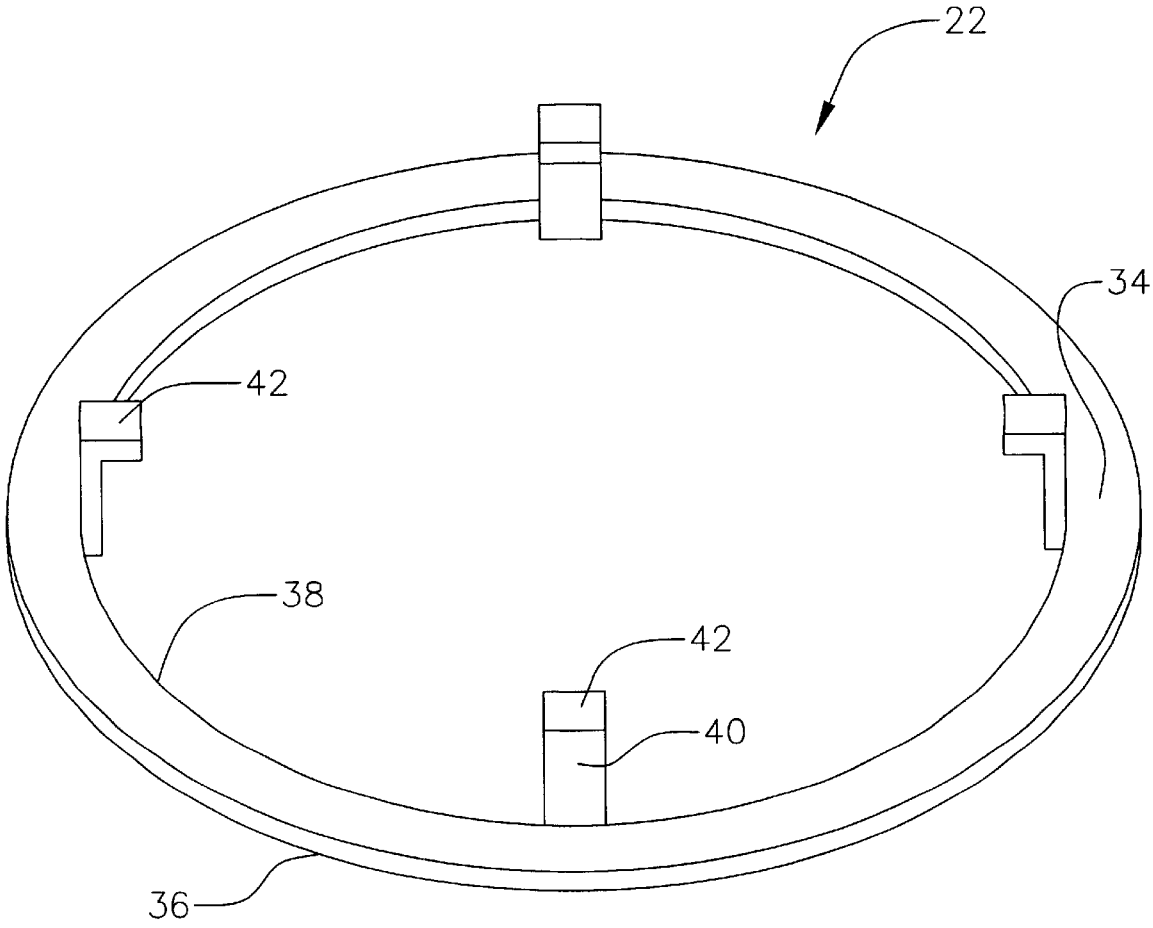
FIG. 6 is a perspective view of a lower ring of the embodiment of FIG. 1.

As shown in FIGS. 5 and 6, the lower ring 22 has a top surface 34 with an outer diameter and an inner diameter, an outer circular lip 36 that extends perpendicularly down from the outer diameter of the top surface 34. The lower ring 22 also has an inner circular lip 38 that extends perpendicularly up from the inner diameter of the top surface 34. The inner circular lip 38 has lip extensions 40 that protrude up from and are substantially parallel to the inner circular lip 38. The spacing, width and location of lip extensions 40 correspond to that of the prongs 26. Each of the four lip extensions 40 have an inwardly extending flange 42. The flanges 42 extend slightly from a top end of each lip extension 40 in a direction towards the center of the lower ring 22. The flanges 42 are spaced from and are substantially parallel to the top surface 34.

Figure 7:
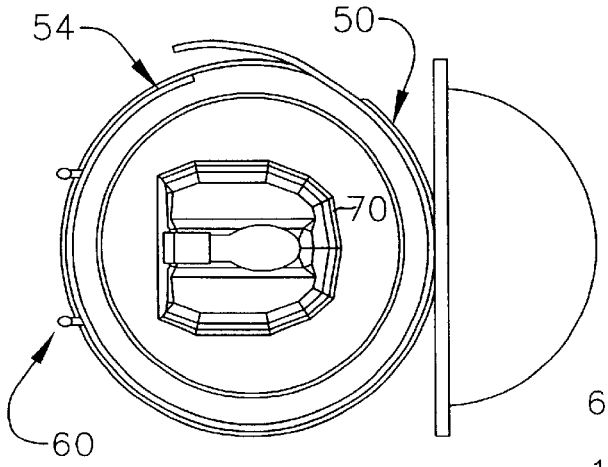
FIG. 7 is a view into the lower door of the globe lighting assembly in the open position.

In one embodiment, shown in FIGS. 5 and 7, the lower door 32 has a top edge plane, a circular lip 48 extending radially outwards from the top edge plane, and an upper circular rim 50 coupled to the circular lip 48. The circular lip 48 is fastened to the upper circular rim 50, in a known manner, or a manner such as through a diffuser clip as described with respect to securing a lower diffuser to a circular rim in FIG. 11.

Preferably the upper circular rim 50 is metal. In cross-section, the upper circular rim 50 is L-shaped, having two legs, a first leg being substantially perpendicular to the circular lip 48, and a second leg being substantially parallel to the circular lip 48. Each of the legs are shaped as a circular ring and coupled to each other. The second leg extends under the circular lip 48 which is spaced from the first leg. When the lower door 32 is in the closed position 12, the first leg of the upper circular rim 50 abuts and/or fits inside of the outer circular lip 36 of the lower ring 22. Consequently, an equator line formed between the two hemispheres of the globe in the closed position 12 is hidden from view behind the lower ring 22.

As shown in FIG. 5, a bottom edge 51 of the upper portion 30 of the globe 20 abuts the lower ring 22 on the top surface 34. The bottom edge 51 sets between the inner circular lip 38, and the prongs 26.

The circular lip 48 aids in preventing moisture that drips from surfaces of the globe 20 from entering an interior of the globe 20. In addition, a gasket 54 is added to seal the globe lighting assembly 10, as shown in FIG. 7. Preferably the gasket is neoprene. The gasket 54 has a slightly smaller diameter than the lower ring 22. The gasket 54 is placed underneath and inside of the lower ring 22, in between the lower ring 22, the upper circular rim 50, and the circular lip 48 of the lower door 32.

Figure 4:
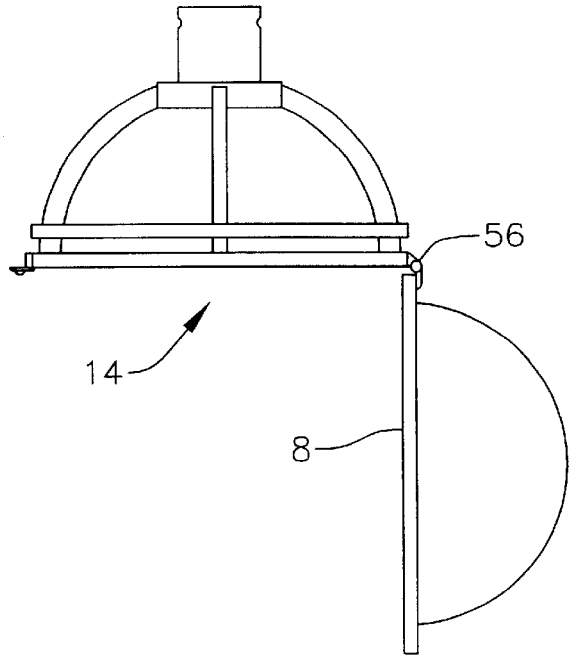
Figure 2:
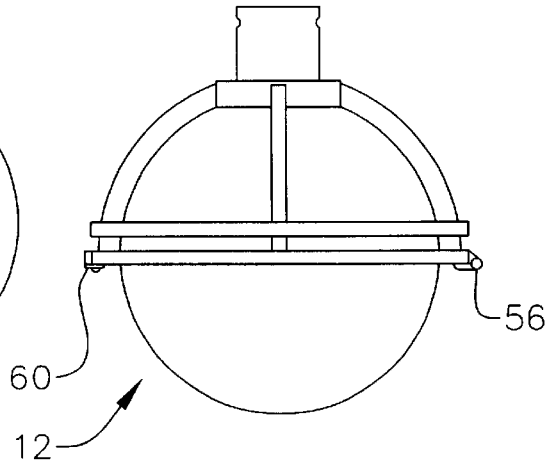

As shown in FIGS. 2 to 4, the lower ring 22 has a hinge 56 that couples the upper portion 30 with the lower door 32. Via the hinge 56, the lower door 32 swings down from the closed position 12 into the open position 14.

As shown in FIG. 5, the hinge 56 is coupled with the upper portion 30 at the outer circular lip (or edge) 36 of the lower ring 22, and coupled with the lower door 32 at the upper circular rim 50. In one embodiment, the hinge 56 is one known in the art. In another embodiment shown in FIGS. 2 to 4, the hinge 56 is a pin hinge with a male part, a female part, and a pin connecting the male and female parts.

Figure 8:
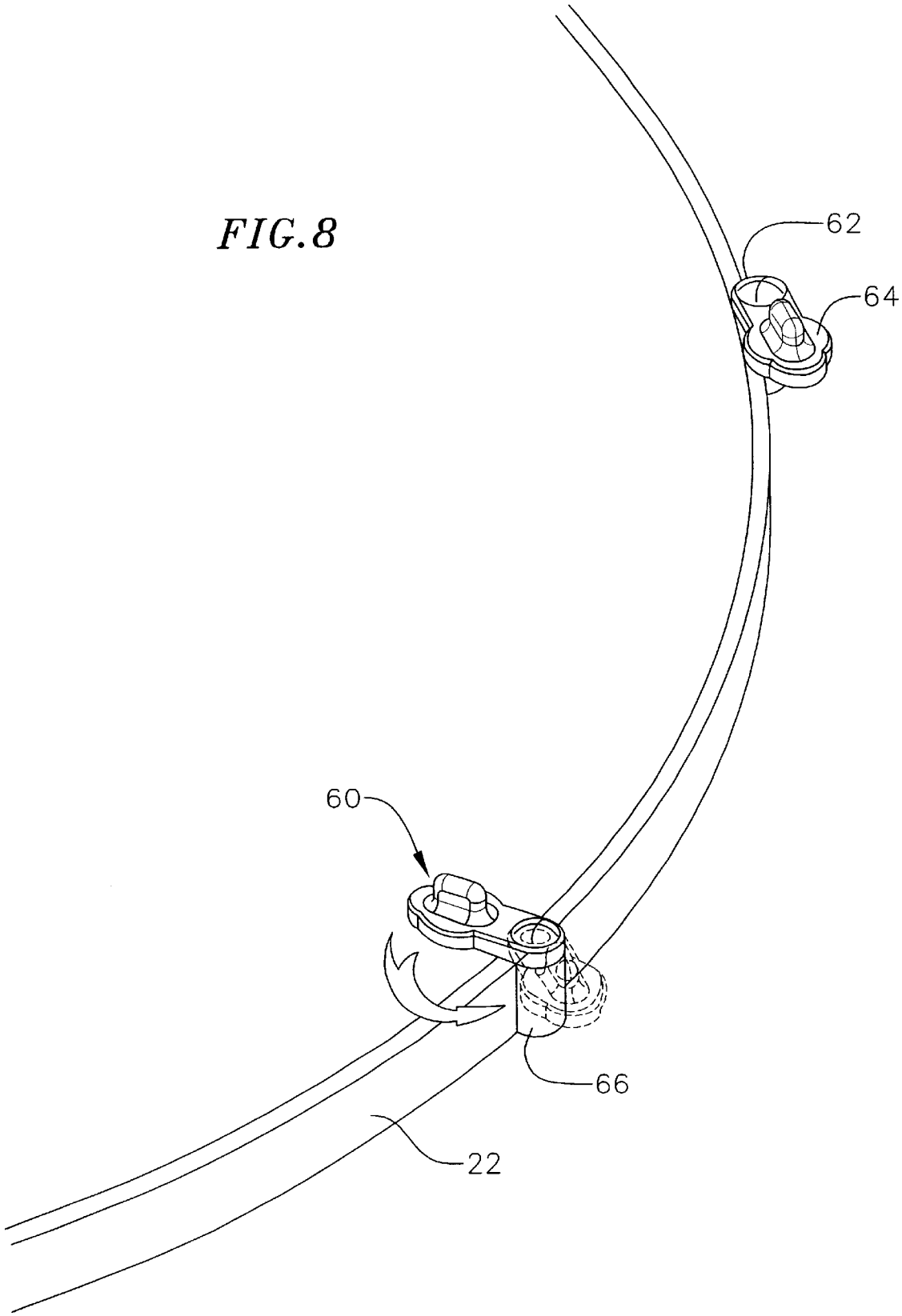
FIG. 8 is a detailed view of the latches shown in FIGS. 2 to 4.

As shown in FIG. 2, a latch 60 holds the lower door 32 in the lower ring 22, thereby keeping the globe lighting assembly 10 in the closed position 12. (Latch 60 is not shown in FIG. 5.) In one embodiment, there are two latches 60 holding the lower door 32 in the lower ring 22. As shown in FIG. 8, each latch 60 has a screw 62, a platform 64, and a jacket 66 on the edge 36 of the lower ring 22. The screw 62 is received into the jacket 66 through the platform 64, thereby coupling the jacket and the platform. The platform 64 is capable of rotating to slide under the upper circular rim 50 of the lower door 32 to secure the lower door 32 into the lower ring 22. When the lower door 32 is secured in this manner, the latch is in an inward position, as shown in FIG. 2. When the platform is rotated through at least 90 degrees, the globe lighting assembly is in the intermediate position shown in FIG. 3. The lower door 32 is then capable of swinging out to the open position shown in FIG. 4.

The upper ring 24 is spaced above and substantially parallel to the top surface 34 of the lower ring 22. Further, the upper ring is coplanar with the flanges 42 of the lower ring 22. As shown in FIG. 5, an inner surface of the upper ring 24 is substantially flush with an inner surface of the prongs 26. The upper ring 24 passes through the width of each of the prongs 26 as the upper ring circles the upper portion of the globe. However, the upper ring 24 extends beyond the prongs 26. In one embodiment, the upper ring 24 has a flange 31 that perpendicularly extends slightly up from an outer surface of the upper ring 24.

As shown in FIG. 5, the upper portion of the spherical globe 20 has top edges, and a cylindrical top flange 33 extending from the top edges in a direction substantially perpendicular to the upper ring. The cylindrical top flange 33 forms a circular aperture in the globe 20. The cylindrical top flange 33 is attached into the hub 28. In one embodiment, diffuser clips can be used to attach the cylindrical top flange 33 as described below with respect to FIG. 11.

Figure 9:
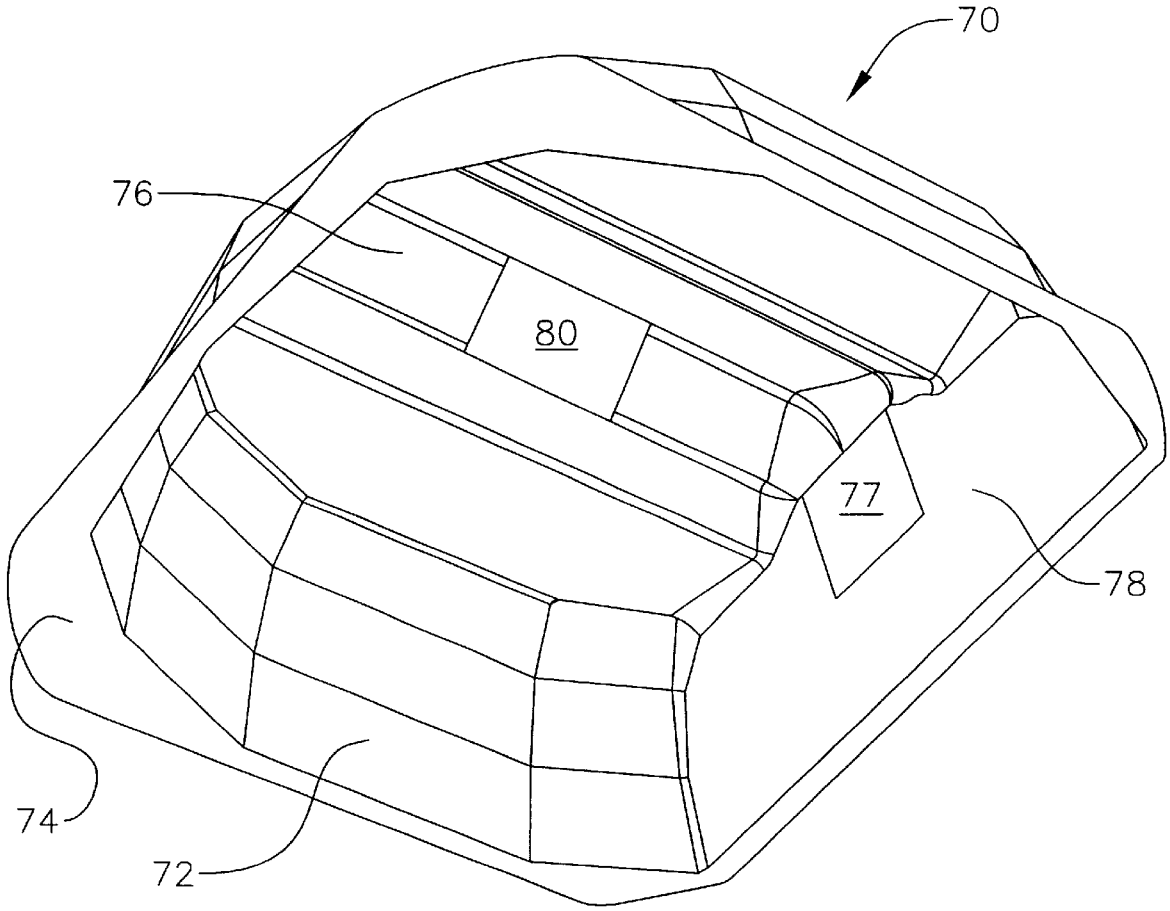
FIG. 9 is a perspective view of a reflector of the embodiment of FIG. 1.

A reflector 70, as shown in FIGS. 5, 7, and 9, is positioned within the upper portion 30 of the globe 20. The reflector 70 attaches to a bottom surface of the flanges 42, through screws, an adhesive, or another known means. The reflector 70 is aluminum and formed substantially in the shape of a hat.

The reflector 70 has three curved side walls 72, a substantially flat wall 78, a rim 74 along bottom edges of the walls that is capable of coupling with the lower ring 22, and a top surface 76 coupled to each of the walls, and substantially perpendicular to the wall 78. The rim 74 has a rectangular shape with rounded edges, but can have any shape that fits within the globe lighting assembly and is capable of connecting with the flanges 42.

There are two apertures in the reflector 70. There is an aperture 80 in the top surface 76. Light from a lamp 84 placed within the reflector 70 passes through the aperture 80 to illuminate the upper portion 30 of the globe 20. There is also a socket clip aperture 77 in the substantially flat wall 78 for insertion of a socket clip 90, as discussed below.

A plastic diffuser 82 covers aperture 80. The plastic diffuser 82 diffuses the light coming from the lamp 84. The plastic is not transparent, but is translucent in that it still allows light through while diffusing the light. Glass 86 is placed under the plastic diffuser 82 to prevent the plastic diffuser 82 from melting under the heat of the lamp 84. The plastic is a white plastic such as an opal polycarbonate diffuser, or an acrylic plastic. The glass is clear tempered glass.

The reflector 70 reflects light from the lamp 84 substantially evenly throughout the lower door 32 of the globe 20.

In combination with the reflector 70, the plastic diffuser 82 covering the aperture 80 allows the light to be evenly dispersed in the upper portion 30 of the globe 20.

The rim 74 secures the reflector 70 to the inwardly extending flanges 42. Alternatively, the outer diameter of the reflector rim 74 substantially corresponds to the inner diameter of the inner circular lip 38, and the reflector 70 attaches to the lower ring top surface 34. However, in this alternative embodiment, no light is dispersed on the upper portion 30 of the globe 20 between the upper ring 24 and the lower ring 22.

In another alternative, the reflector 70 attaches to a flange (not shown) that is spaced a greater distance from the lower ring top surface 34 than the inwardly extending flange 42. The flange is parallel to, but not coplanar with, the upper ring. As a result, a 'hot spot' is thereby created on the upper portion 30 of the globe 20 between the reflector rim 74 and the upper ring 24.

Figure 10:
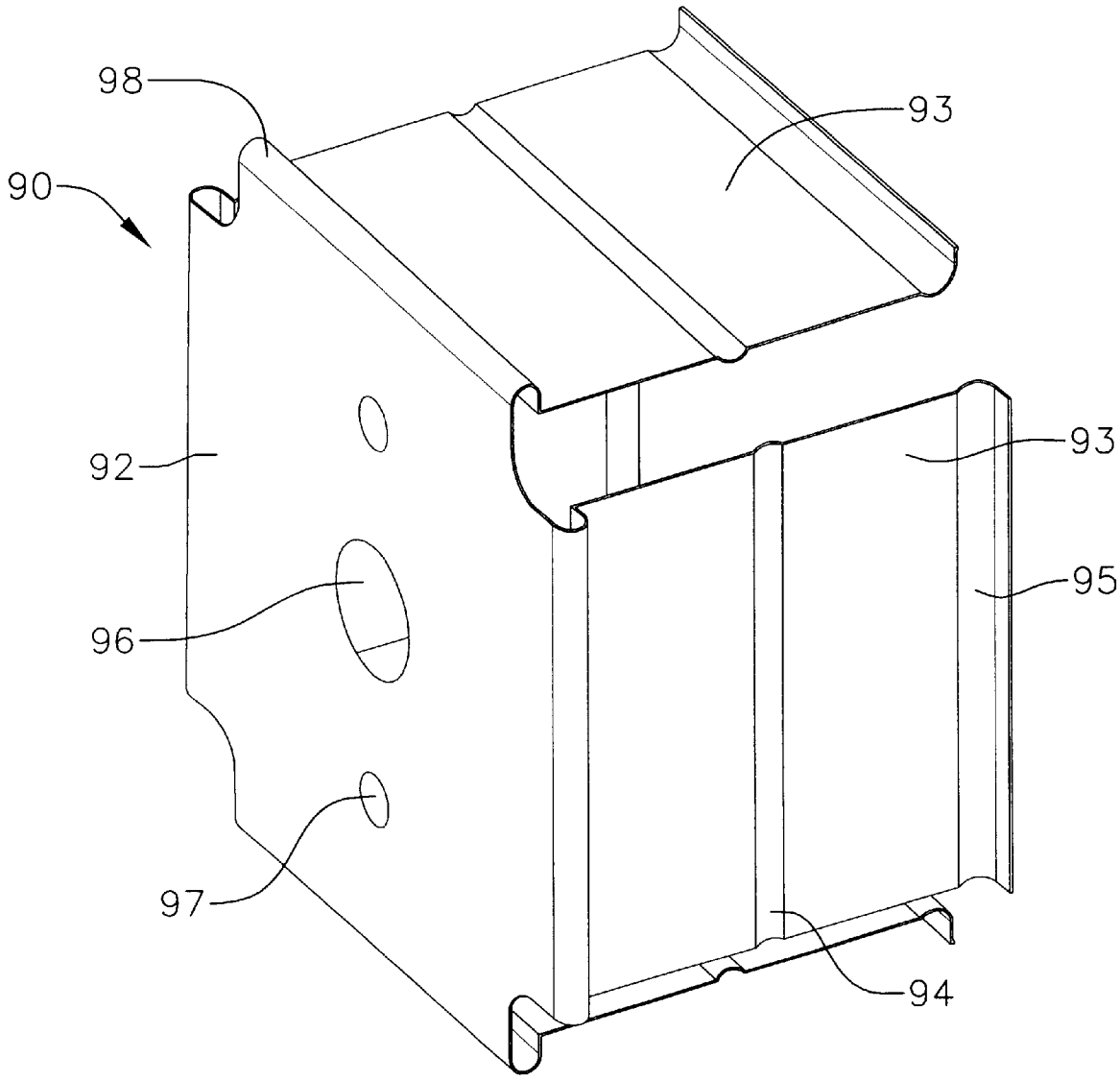
FIG. 10 is a perspective view of a socket clip of the embodiment of FIG. 1.

The socket clip 90 is illustrated in FIG. 10. Preferably the socket clip 90 is comprised of metal, such as aluminum. The socket clip 90 is substantially shaped as an open box with a top surface 92 and four attached legs 93. The top surface 92 has a central hole 96 and mounting holes 97 for attachment to the lamp 84. Along the legs 93 are convexly curved upper edges 98 at a junction with side edges of the top surface 92, a concave indentation 94 at a mid portion on each of the legs 93, and a concavely curved lower edge 95 along each bottom of the legs 93.

There are three settings for the socket clip 90 in the socket clip aperture 77 of the reflector 70. The first setting is the socket clip 90 inserted into the aperture 77 where the convexly curved upper edges 98 abut edges in the aperture 77. The second setting is where the socket clip 90 is partially inserted about halfway into the aperture 77. In the second setting, the aperture edges settle into the concave indentation 94 of each of the legs 93. The third setting is where the socket clip 90 is slightly inserted into the aperture 77. In the third setting, the aperture edges snap into the concavely curved lower edge 95 and the socket clip is held in this setting by the aluminum legs, as discussed below.

Each of the three settings of the socket clip 90 render a different location of the lamp 84 in the globe 20 and a different light distribution in the upper portion 30 of the globe 20. The third setting has a more oval light distribution and the lamp 84 is set furthest into a central area of the globe 20. The first setting has a more circular light distribution and the lamp 84 is set adjacent to the side flat wall 78 of the reflector 70. The second setting has the socket clip positioned in between the two light distributions and locations. Depending on the desired light distribution, the socket clip 90 is positioned in one of the three settings.

In one embodiment, the legs 93 of the socket clip 90 are biased in a direction opposing each other, respectively. The legs 93 thereby have adequate resistance to maintain and hold the socket clip 90 in the desired setting. The legs push against the aperture edges, and frictionally maintain the socket clip in the aperture 77 at the desired setting.

In one embodiment, the legs 93 are flexible. The flexible legs 93 allow adjustability of the socket clip 90 in the aperture 77 between the three settings as desired. In order to adjust the legs 93, the legs 93 are deformed by pressing them in towards each other and then the socket clip 90 is moved to the next setting. The legs 93 are then released to spring back against the aperture edges into the desired position.

Figure 11:
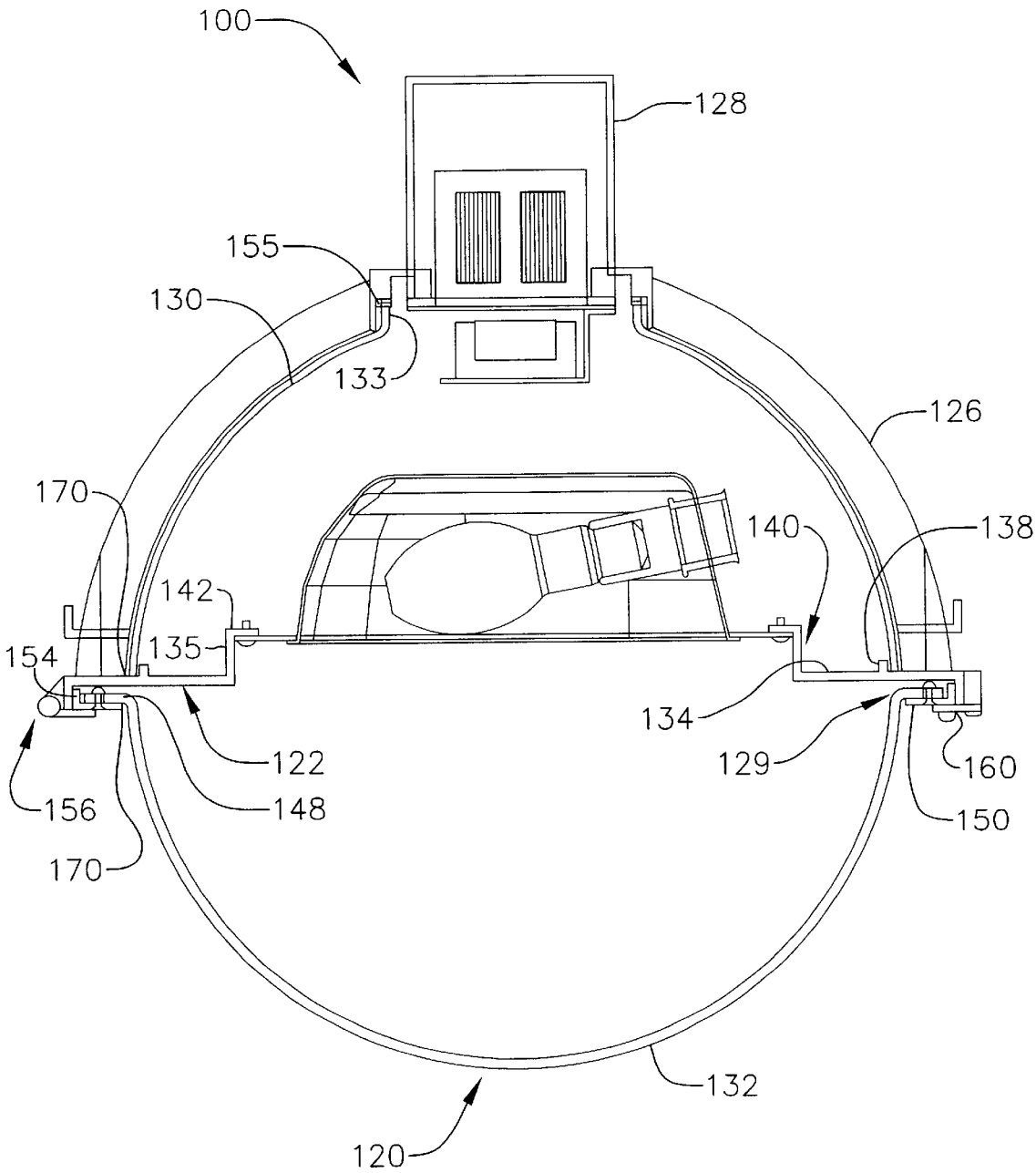
FIG. 11 is a cross-sectional view of an alternate embodiment of the globe lighting assembly.

FIG. 11 illustrates another embodiment of the present invention, a globe lighting assembly 100. The globe lighting assembly 100 has an upper diffuser 130, a bottom diffuser 132, and a cage 118. The cage 118 has a lower ring 122, a hub 128, and cage prongs 126 that extend from the hub 128 to the lower ring 122. The globe assembly 100 is similar to the globe assembly 10 of FIGS. 1–10, with some exceptions. Particularly, the globe assembly has a lower ring 122 that is different than the lower ring 22.

The lower ring 122 has a top surface 134 with an outer diameter and an inner diameter, a first inner circular lip 138 that extends perpendicularly up from the top surface 134 at about midway between the outer and inner diameters, and a second inner circular lip 135 that extends perpendicularly up from the inner diameter of the top surface 134. The second inner circular lip 135 has lip extensions 140 that protrude up from and are substantially parallel to the second inner circular lip 135. The spacing, width and location of lip extensions 140 correspond to that of the prongs 126. Each of the four lip extensions 140 have an inwardly extending flange 142. The flanges 142 extend slightly from a top end of each lip extension 140 in a direction towards the center of the lower ring 122. The flanges 142 are spaced from and are substantially parallel to the top surface 134.

The upper diffuser 130 of the spherical globe 120 has top edges, and a cylindrical top flange 133 extending from the top edges in a direction substantially perpendicular to the upper ring. The cylindrical top flange 133 forms a circular aperture in the globe 120. The cylindrical top flange 133 is attached into the hub 128 through diffuser clips which are similar to diffuser clips 129 described below. A circular neoprene gasket 155 seals the area between the outer cylindrical top flange 133 and the cage hub 128.

The lower diffuser 132 has a top edge plane, a circular lip 148 extending radially outwards from the top edge plane, and an upper circular rim 150 coupled to the circular lip 148. The circular lip 148 is fastened to the upper circular rim 50 through a diffuser clip 29. In one embodiment, four diffuser clips 129 are used to secure the lower diffuser 132 to the circular rim 150. Each of the diffuser clips 129 have a metal plate with an aperture (not shown), a screw received into the aperture, a nut to hold the screw in the metal plate. The metal plate is placed on the circular lip 148, and from underneath the globe lighting assembly, the screw is placed up through an aperture (not shown) in the circular rim 150, an aperture (not shown) in the circular lip 148, and finally through the aperture in the metal plate. The nut is screwed over the end of the screw to secure the diffuser clip 129 in place.

The lower ring 122 has a hinge 156 that couples the upper diffuser 130 with the lower diffuser 132. Via the hinge 156, the lower diffuser 132 swings to an open position. At an end of the lower diffuser, opposite the hinge 156, is a latch 160 that holds the lower diffuser 132 in the lower ring 122. Latch 160 is similar to latch 60 described above.

In one embodiment shown in FIG. 11, silicon 170 is applied on the outside of the upper diffuser 130 along the top surface of the lower ring. Silicon seals the edges of the upper diffuser 130 to aid in preventing access to moisture, bugs and the like. Additionally or alternatively, silicon 170 is applied on the lower diffuser 132 at the connection between the circular lip 148 and the upper circular rim 150. Silicon may be applied in similar locations on the globe lighting assembly 10 of FIGS. 1–10.

Figure 12:
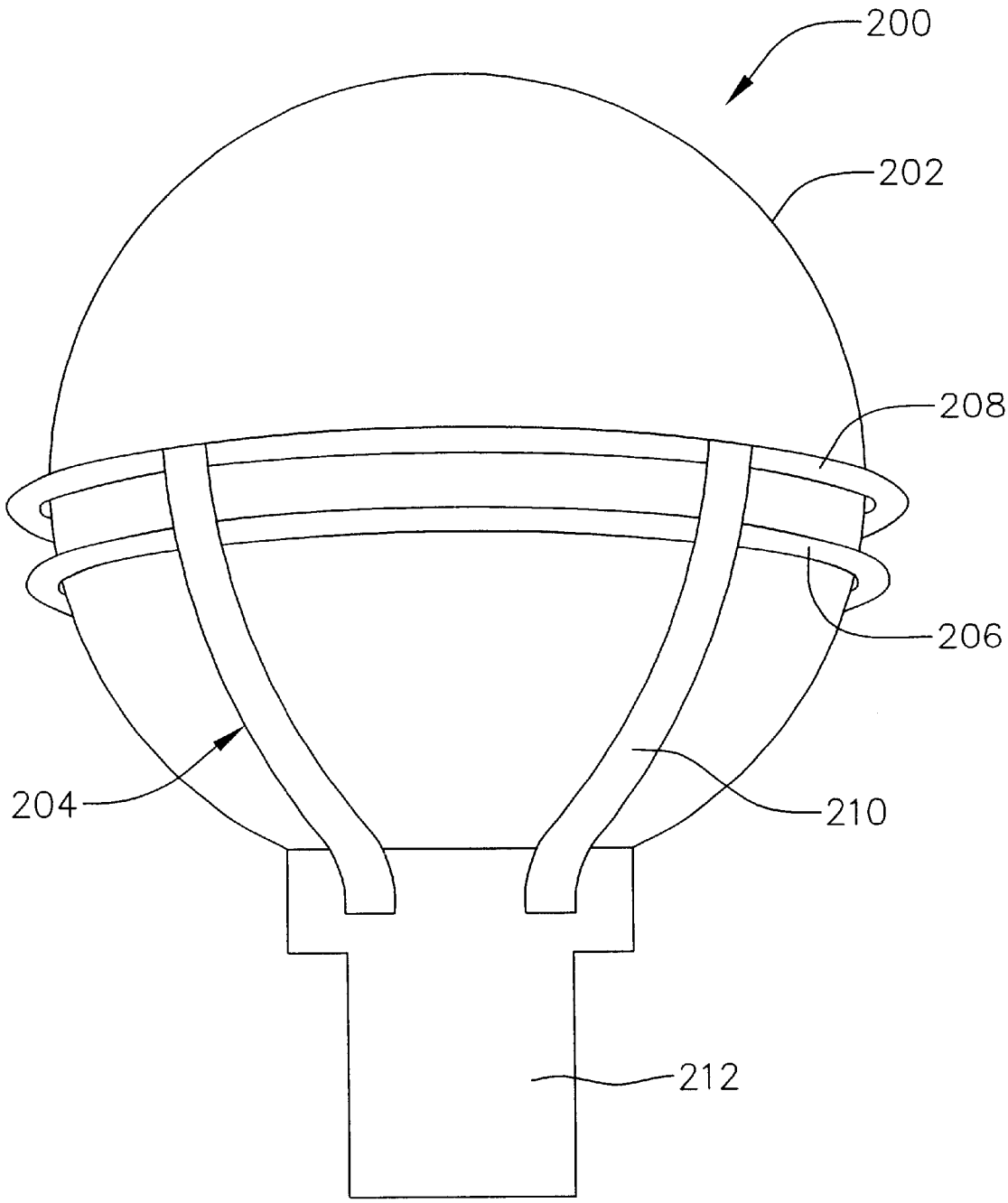
FIG. 12 is a perspective view of another alternate embodiment of the globe lighting assembly.
Figure 13:
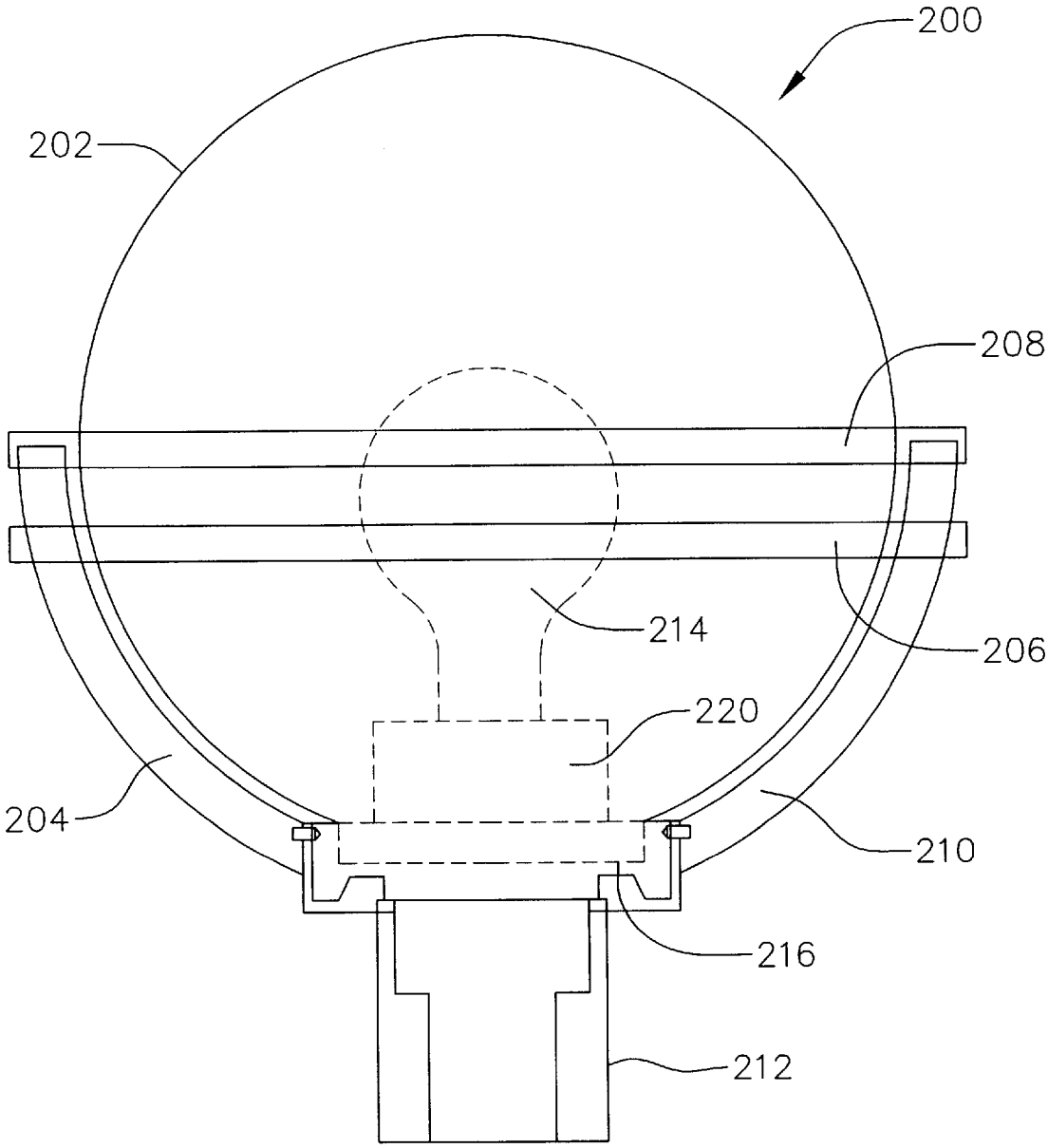
FIG. 13 is a cross-sectional view of the alternative embodiment of FIG. 12.

FIGS. 12 and 13 illustrate yet another embodiment of the present invention, a globe lighting assembly 200. The globe lighting assembly 200 has a bottom hub 212, a globe 202 that fits into the bottom hub 211, and a cage 204 that surrounds the globe and extends from the bottom hub 212.

The cage 204 has a bottom ring 206, a top ring 208, and prongs 210. The bottom and top rings 206, 208, along with the prongs 210, give structural support for the globe 202. Similar to the embodiment described with respect to FIG. 1, there are generally four prongs 210 each spaced approximately equal from each other around the globe 202.

The globe 202 has a lamp 214 that fits into a socket 220 coupled with the bottom hub 212. The globe 202 has a general spherical shape with a cylindrical bottom flange 216. The cylindrical bottom flange 216 attaches to edges of a circular aperture in a bottom of the sphere. As a result, the cylindrical bottom flange 216 protrudes slightly from the bottom of the sphere in a direction substantially perpendicular to the plane of the circular aperture. The cylindrical bottom flange 216 is connected by means such as the diffuser clips described above or by conventional screws into the hub 212 of the cage 204.

Usually, the hub connects the globe lighting assembly to a lamp post, so that the assembly hangs from an arm of the post. Alternatively, the hub connects the assembly to another above attachment, such as a ceiling.

The appearance and shape of the globe lighting assembly is shown in the Pat. Design application No. 29/102,578, filed Mar. 26, 1999.

It will be understood that the foregoing is merely illustrative of the principles of the invention, and that various modifications (such as the number of cage prongs can be greater than or less than four, the globe can be comprised of alternate materials such as glass, the first embodiment can also be oriented 'upside-down' or 'sideways') can be made by those skilled in the art without departing from the spirit and scope of the invention.

What is claimed is:

1. A globe lighting assembly comprising:

a globe with a first portion and a second portion, wherein the globe is substantially spherically shaped, wherein the first portion and the second portion are substantially two separable hemispheres and each comprises a material through which light can pass; and a cage with a lower ring and prongs that each partially surround the globe, wherein the first portion of the globe is received into and coupled with the cage;

wherein the first portion is stationary and the second portion is hingedly attached to the first portion so that the second portion can rotate away from the first portion to provide access to the interior of the globe.

2. The globe lighting assembly of claim 1 wherein the globe is plastic and the cage is metallic.

3. The globe lighting assembly of claim 1 wherein the globe has a line in between the first portion and the second portion, wherein the lower ring surrounds the globe to cover the line.

4. The globe lighting assembly of claim 1 further comprising an upper ring, wherein the lower and upper rings along with the prongs surround and give structural support for the first portion of the globe.

5. The globe lighting assembly of claim 1 wherein there are four prongs spaced approximately equal from each other around the globe.

6. The globe lighting assembly of claim 1 wherein there are more than four prongs spaced approximately equal from each other around the globe.

7. The globe lighting assembly of claim 1 wherein the second portion has a circular rim that fits into an inner surface of the lower ring when the assembly is in a closed position.

8. A globe lighting assembly comprising:

a globe with a stationary portion and a door, wherein the globe is substantially spherically shaped, wherein the stationary portion and the door are substantially two separable hemispheres and each comprises a material through which light can pass, whereby the door can rotate away from the stationary portion to provide access to the interior of the globe; and a cage having prongs and a lower ring with an inner circular lip that extends into an interior of the globe, wherein the inner circular lip is capable of aiding in preventing moisture from entering the globe interior, wherein the stationary portion has an edge that attaches to the lower ring just to an outside of the inner circular lip.

9. The globe lighting assembly of claim 8 wherein the lower ring has lip extensions extending from the inner circular lip.

10. The globe lighting assembly of claim 9 wherein each lip extension has an end and a flange extending from the end of the lip extension, wherein the flange is substantially coplanar with the upper ring.

11. The globe lighting assembly of claim 10 further comprising a reflector with a rim, wherein the rim of the reflector attaches to at least one flange.

12. The globe lighting assembly of claim 11 further comprising a light source positioned in the globe, wherein the reflector has an aperture covered with a light diffuser, wherein light from the light source is emitted to the globe interior through the light diffuser.

13. The globe lighting assembly of claim 12 wherein the light diffuser is one of polycarbonate and an acrylic plastic.

14. The globe lighting assembly of claim 12 wherein the light diffuser is a plastic material and a glass material between the plastic and the light source.

15. The globe lighting assembly of claim 11 further comprising a light source socket clip, wherein the reflector has an aperture dimensioned to receive the socket clip.

16. The globe lighting assembly of claim 15 wherein the socket clip has at least one position with respect to the reflector.

17. The globe lighting assembly of claim 16 wherein the socket clip has four legs, wherein each of the four legs have multiple settings that correspond to the positions of the socket clip in the reflector.

18. The globe lighting assembly of claim 16 wherein the legs are flexible and are biased away from each other such that there is adequate resistance to maintain and hold the legs in the determined setting.

19. The globe lighting assembly of claim 12 further comprising at least one latch that latches the door to the lower ring.

20. The globe lighting assembly according to claim 1, wherein the globe comprises a substantially spherically-shaped globe wall defining an interior region and the assembly further comprises:

a reflector mounted in the interior region of the globe, the reflector comprising a plurality of walls defining an interior region of the reflector, wherein the walls only partially surround the interior region of the reflector so that at least a portion of the interior region of the reflector is in communication with the interior region of the globe, and further wherein at least a portion of the walls are capable of reflecting light; and a source of light mounted within the interior region of the reflector.

21. The globe lighting assembly of claim 20, wherein the reflector is mounted in an upper portion of the globe.

22. The globe lighting assembly of claim 21, wherein the reflector comprises a top wall and one or more side walls, whereby the bottom of the reflector is open so that light can pass from the interior region of the reflector into a lower portion of the globe.

23. The globe lighting assembly of claim 22, wherein the top wall includes an aperture covered by a diffuser to thereby permit light to pass from the interior region of the reflector, through the aperture, and into the upper portion of the globe.

24. The globe lighting assembly of claim 23, wherein the diffuser comprises a translucent material.

25. The globe lighting assembly of claim 20, wherein at least one of the walls of the reflector includes an aperture covered by a diffuser to thereby permit light to pass from the interior region of the reflector, through the aperture, and into the interior region of the globe.

26. The globe lighting assembly of claim 25, wherein the diffuser comprises a translucent material.

27. The globe lighting assembly of claim 20, wherein the reflector comprises aluminum.

28. The globe lighting assembly of claim 20, wherein the reflector further comprises a rim extending outwardly from one or more of the plurality of walls, wherein the rim is mounted to one or more flanges extending inwardly from the globe wall.

29. The globe lighting assembly of claim 20, wherein the light source is adjustably mounted the reflector, whereby the position of the light source relative to the reflector can be adjusted.

30. The globe lighting assembly of claim 29, wherein the light source is connected to a socket clip that is adjustably mounted in an aperture in a wall of the reflector, whereby the position of the socket clip relative to the reflector can be changed by adjusting the position of the socket clip in the aperture.

31. The globe lighting assembly of claim 30, wherein the socket clip is moveable between three different positions.

* * * * *